US007201539B2

(12) United States Patent
Schmets

(10) Patent No.: US 7,201,539 B2
(45) Date of Patent: Apr. 10, 2007

(54) DIVING AID

(75) Inventor: Eric Alexander Schmets, P.O. Box 613, Fourth Floor Harbour Centre, Georgetown, Grand Cayman, Cayman Islands (KY)

(73) Assignees: Eric Alexander Schmets (KY); Eric Van Der Werff (NL)

( * ) Notice: Subject to any disclaimer, the term of this patent is extended or adjusted under 35 U.S.C. 154(b) by 0 days.

(21) Appl. No.: 10/451,113

(22) PCT Filed: Dec. 18, 2001

(86) PCT No.: PCT/NL01/00920

§ 371 (c)(1),
(2), (4) Date: Sep. 13, 2004

(87) PCT Pub. No.: WO02/49910

PCT Pub. Date: Jun. 27, 2002

(65) Prior Publication Data

US 2005/0019101 A1 Jan. 27, 2005

(30) Foreign Application Priority Data

Dec. 19, 2000 (NL) ..... 1016912

(51) Int. Cl.
*B63C 11/26* (2006.01)

(52) U.S. Cl. ..... 405/186; 405/185

(58) Field of Classification Search ..... 405/185, 405/186

See application file for complete search history.

(56) References Cited

U.S. PATENT DOCUMENTS

| | | | | |
|---|---|---|---|---|
| 3,469,231 | A * | 9/1969 | Hermann et al. | 367/122 |
| 3,786,406 | A * | 1/1974 | Bianco | 367/134 |
| 4,336,591 | A * | 6/1982 | Berdzar et al. | 73/291 |
| 4,635,242 | A * | 1/1987 | Hart | 367/134 |
| 5,200,932 | A | 4/1993 | Ljung | |
| 5,523,982 | A * | 6/1996 | Dale | 367/131 |
| 5,841,345 | A * | 11/1998 | Kestenberg | 340/440 |
| 5,899,204 | A * | 5/1999 | Cochran | 128/205.23 |
| 6,054,929 | A * | 4/2000 | Garofalo et al. | 340/626 |
| 6,125,080 | A * | 9/2000 | Sonnenschein et al. | 367/134 |
| 6,272,073 | B1 * | 8/2001 | Doucette et al. | 367/131 |
| 6,618,059 | B1 * | 9/2003 | Furuta | 715/772 |
| 6,762,678 | B2 * | 7/2004 | Arens | 340/506 |
| 6,856,578 | B2 * | 2/2005 | Magine et al. | 367/134 |

FOREIGN PATENT DOCUMENTS

| | | |
|---|---|---|
| FR | 2 695 747 A | 3/1994 |
| FR | 2 740 426 | 4/1997 |
| FR | 2 741 853 | 6/1997 |
| FR | 2 755 023 A | 4/1998 |
| GB | 2 267 373 A | 12/1993 |
| GB | 2 295 910 A | 6/1996 |
| GB | 2 316 784 A | 3/1998 |
| JP | 2000019272 | 1/2000 |
| WO | WO 94 06264 A | 3/1994 |
| WO | WO 00/58747 | 10/2000 |

* cited by examiner

*Primary Examiner*—Frederick L. Lagman
(74) *Attorney, Agent, or Firm*—Thomas, Kayden, Horstemeyer & Risley LLP; Todd Deveau

(57) ABSTRACT

Diving aid for divers, at least comprising a power supply, alarm sound-generating means (3) and activating means (2) for activating the sound-generating means (3), which activating means (2) are designed in such a way that when the alarm device is in use said activating means can be activated by an uncontrolled shock load, and that the device comprises means (6) for attaching to the divers's body or the divers's equipment in an unmistakable orientation. The diving aid according to the invention is preferably designed in the form to a wristwatch.

11 Claims, 1 Drawing Sheet

DIVING AID

RELATED APPLICATION

This application claims priority to and the benefit of NL1016912 filed Dec. 19, 2000.

FIELD OF THE INVENTION

The present invention relates to a diving aid.

BACKGROUND OF THE INVENTION

A major problem encountered by both experienced and inexperienced divers during diving is so-called dive stress, in particular pre-dive stress. This dive stress increases the likelihood of mistakes being made prior to and during diving, mistakes which can have fatal consequences. The chance of a panic situation under water is also increased considerably by this dive stress.

In practice, it is found that most divers dive only once or twice a year. These are the divers at greatest risk. It has been found that when such an inexperienced diver is in distress or in danger he has only three seconds in which it is possible to take action. In the first second the distress or danger is perceived, in the second second the diver becomes aware of the problem and his position, and in the third second the diver is in a panic. The most common reaction of such divers is to swim as fast as possible towards the surface, with all the risks this involves.

In a panic situation inexperienced divers are found to be incapable of any coordinated movement, for example in order to activate an alarm device. The known alarm devices for use as diving aids are therefore found to be inadequate.

In this connection reference is made to FR-A-2,695,747. This French patent application discloses an alarm device for attaching to the wrist. This device comprises two parts that are rotatable relative to each other and can be locked relative to each other by means of a locking pin. This locking pin has to be removed in order to activate the alarm device.

FR-A-2,755,023 also discloses an alarm device, which comprises a housing with a battery and sound-generating means. The housing comprises a push-button for activating the alarm device. This alarm device is attached to an eye present on the housing.

It has been found that a diver who is in a panic is incapable of removing a locking pin in a controlled manner or locating and pressing a push-button on a trailing device. Divers also very often wear gloves during diving, which makes such actions even more difficult. Furthermore, a fully equipped diver has very limited freedom of movement.

SUMMARY OF THE INVENTION

There are also alarm devices that are operated by compressed air and are therefore connected to the compressed air system of the diver. A common problem is that the diver is not getting any air and there is a fault in the compressed air system. Such devices are therefore not sufficiently reliable, even if the diver were capable of activating the activating means.

In other words, all devices known in the prior art require coordinated movements from the diver. These devices are therefore found to be inadequate in practice. Knowledge of this fact increases both pre-dive stress and dive stress among divers. There is consequently a great demand for a diving aid that can give the diver a relaxed and safe feeling.

The object of the present invention is to meet this demand, and to that end the invention provides a diving aid at least comprising a power supply, alarm sound-generating means and activating means for activating the alarm sound-generating means, which activating means are designed in such a way that when the alarm device is in use said activating means can be activated by an uncontrolled shock load, and that the device comprises means for attaching to the diver's body or the diver's equipment in an unmistakable orientation.

The diving aid according to the invention is found to be extremely satisfactory, even in a situation where an inexperienced diver panics. It appears that an inexperienced diver in a panic is in fact only capable of making an uncoordinated striking movement with one hand in the direction of the alarm device. For the device according to the invention, this is sufficient to activate the latter and make co-divers aware of the distress or danger. It has been proved in practice that knowledge of the substantially increased safety under water through use of the diving aid according to the invention substantially reduces dive stress even in the case of very experienced divers.

It is pointed out that alarm devices that can be activated by an uncontrolled shock load are known for use on dry land. These devices are not, however, suitable for use under water. In this connection; reference is made to GB-A-2,267,373, GB-A-2,295,910 and GB-A-2,316,784.

Apart from alarm sound-generating means, other means can, of course, also be used for alerting co-divers. The diving aid also preferably comprises light-signal-generating means, which are connected to the activating means.

Under water the speed of sound is many times higher than it is in air. The result of this is that under water the human ear is not capable of determining the direction of sound. It is therefore preferable to use light-signal-generating means, such as, for example, a stroboscopic lamp or a stroboscopic LED. Such lighting means are known in the prior art.

Another advantage of using light-generating means is that a diver in distress can be located easily even when diving at night or in murky water. Of course, the advantages also apply to a victim who is unconscious, who can be found more easily in this way.

The activating means can be designed in many different ways according to the invention. The activating means preferably comprise a relatively large push-button. The push-button is so large that it can be pressed with certainty by an arbitrary uncontrolled striking movement. The surface of the push-button is advantageously at least 2 $cm^2$. More advantageously, the push-button also projects from the surface of the diving aid. In the case of a large push-button it is advantageous if said button is provided with passages for water, so that the water pressure of the environment under the button can be evened out. This ensures that during diving the diving aid is not activated undesirably by the pressure of the water.

In particular, a striking colour, for example red or yellow, is selected for such a push-button.

The activating means advantageously comprise an acceleration detector. An example of this is a so-called tilt detector. Such detectors are switches that are known in the prior art and can be activated by a shock load, without the direction of the shock load being important.

The diving aid can comprise an ON/OFF button, for switching on the diving aid just before diving, and for switching it off after diving. The diving aid preferably comprises water detection means for switching on the diving aid as soon as it comes into contact with water. This has the advantage that the diving aid is therefore always switched on under water, even if the diver forgets to switch on the diving aid. Such water detection means are known in the prior art. An example of these means is the detection electrodes that are also used on diving computers. In this context the term switching on means putting the diving aid into a state ready for use. In other words, when the diving aid is not switched on operation of the activating means will not result in the generation of an alarm sound.

In particular, the diving aid is designed in such a way that it can be worn on the wrist. In practice, it has been found that the wrist is a suitable place for attachment of the diving aid, since in practice said diving aid can be reached easily with the other hand, so that in a panic situation the diving aid can be activated by an uncoordinated movement.

It will be clear that the diving aid can likewise be attached to the diver's equipment, provided that this attachment involves an unmistakable orientation, so that the diver can always reach the diving aid. As a particular example of this, the means for attaching the diving aid to the diver's body or the diver's equipment comprise a clip.

In a special embodiment the diving aid forms part of an ordinary diving computer. An ordinary diving computer is a device from which, inter alia, the diving depth, the diving time that has elapsed and the like can be read.

BRIEF DESCRIPTION OF THE DRAWINGS

The invention will be explained in greater detail below with reference to the appended drawing, in which.

DETAILED DESCRIPTION OF THE DRAWINGS

Figure 1:
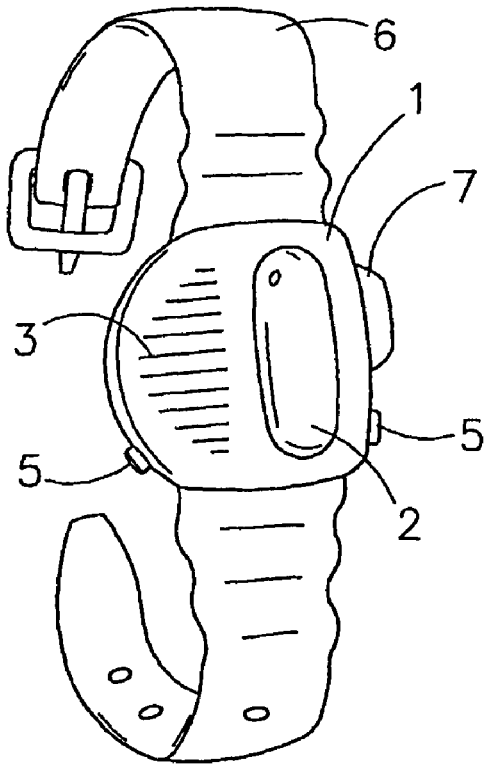
FIG. 1 shows a top view of an embodiment of a diving aid according to the invention.

FIG. 1 shows an embodiment of a diving aid according to the invention, which is suitable for attachment around the wrist. The diving aid comprises a housing 1 on which a large push-button 2 and alarm sound-generating means 3 are situated. Reference numeral 5 indicates two water detection electrodes, which serve to activate the diving aid on contact with water. A power supply is not shown in the figures, but it will be clear that in principle any power supply that is suitable for use under water can be used. An example in this case is a power supply for a diving computer or the like.

Reference numeral 6 indicates a wristband for attachment of the diving aid to a diver's wrist.

Finally, reference numeral 7 indicates a reset button, by means of which the diving aid can be switched off after being activated, for example when the diver in distress or danger has been rescued.

For testing the functioning of the diving aid according to the invention above water, the diving aid can be switched on by touching the electrodes with moistened fingertips.

It will be clear that the diving aid is certain to be activated when in a panic situation a striking movement with the hand is made in an uncontrolled way in the direction of the diving aid according to the invention. All this has been confirmed by experiments.

The alarm sound-generating means in this case are in the form of a piezoelectric sound-generating device.

Figure 2:
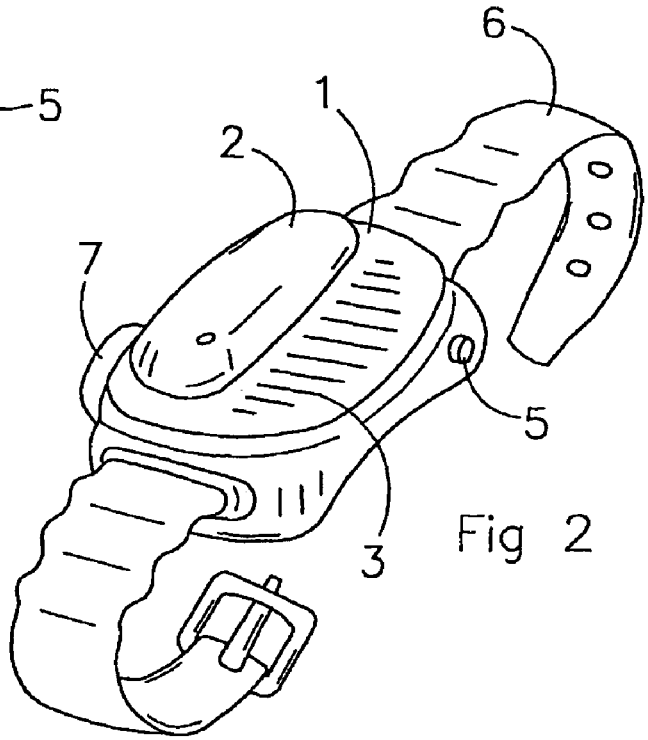
FIG. 2 shows a perspective view of the embodiment according to FIG. 1.

FIG. 2 shows the diving aid according to FIG. 1 in perspective view. It can be seen clearly in this figure that the large push-button 2 projects slightly from the surface of the device, so that said push-button is easy to press.

Figure 3:
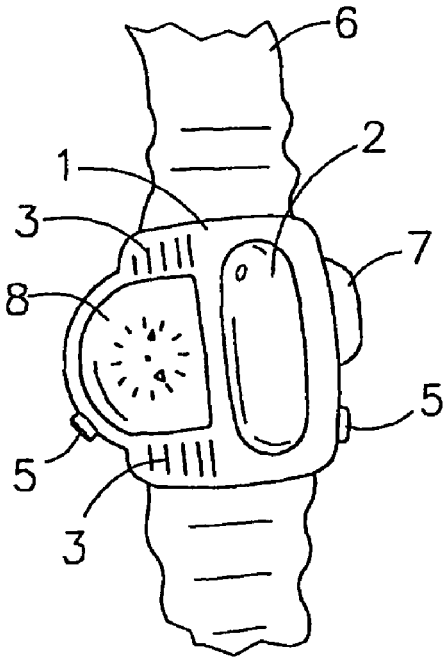
FIG. 3 shows a top view of a different embodiment of a diving aid according to the invention.
Figure 4:
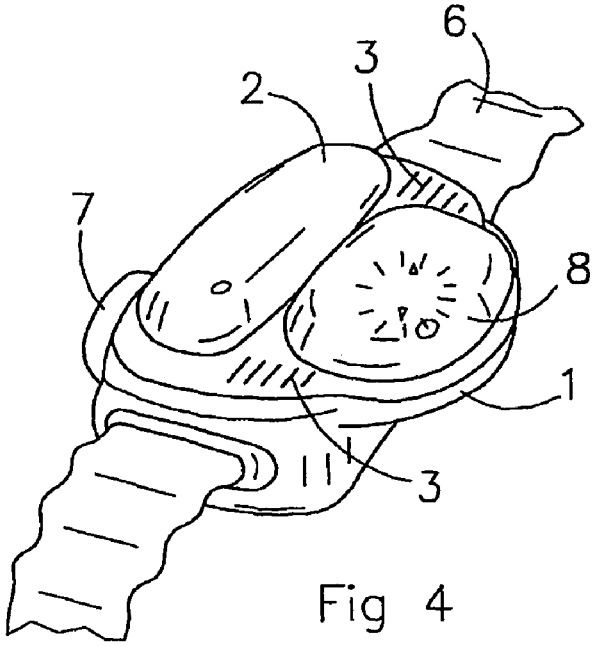
FIG. 4 shows a perspective view of the embodiment according to FIG. 3.

FIGS. 3 and 4 show a different preferred embodiment of a diving aid according to the invention, in which similar parts are indicated by the same reference numerals.

Apart from the alarm sound-generating means, this diving aid also comprises a stroboscopic xenon gas discharge lamp 8, for generating a light alarm. When a diver in distress/danger uses this diving aid, he will be able to indicate his position not only by means of an audible sound signal, but also by means of light signals. This means that the diver can be found even more quickly by co-divers.

The invention claimed is:

1. Diving aid for reducing the dive stress of divers comprising a power supply, alarm sound-generating means and activating means for activating the alarm sound-generating means, which activating means are designed in such a way that when the alarm device is in use said activating means can be activated by an uncontrolled shock load caused by an arbitrary uncontrolled striking movement of the diver, and which device also comprises means for attaching to the diver's body or the diver's equipment in an unmistakable orientation.

2. Diving aid according to claim 1, wherein the diving aid also comprises light-signal-generating means that are connected to the activating means.

3. Diving aid according to claim 1 wherein the activating means comprise a push-button.

4. Diving aid according to claim 1, wherein the activating means comprise an acceleration detector.

5. Diving aid according to claim 1, wherein the diving aid comprises water detection means by means of which the device can be activated.

6. Diving aid according to claim 1, wherein the diving aid is designed in the form of a wristwatch.

7. Diving aid according to claim 1, wherein the means for affaching the diving aid to the diver's body or the diver's equipment comprise a clip.

8. Diving aid according to claim 1, wherein the diving aid forms part of an ordinary diving computer.

9. Diving aid according to claim 1 for use in reducing pre-dive stress.

10. Diving aid for reducing the dive stress of divers comprising a power supply, alarm sound-generating means and activating means for activating the alarm sound-generating means, which activating means are designed in such a way that when the alarm device is in use said activating means can be activated by an uncontrolled shock load, caused by an uncoordinated or an arbitrary uncontrolled striking movement of the diver, and which device also comprises means for attaching to the diver's body or the diver's equipment in an unmistakable orientation, wherein the activating means comprise a push-button and the push-button is a large push-button positioned on and projecting from a surface of the diving aid opposite the diver's body and away from any other button.

11. Diving aid for reducing the dive stress of divers comprising a power supply, alarm sound-generating means and activating means for activating the alarm sound-generating means, which activating means are designed in such a way that when the alarm device is in use said activating means can be activated by an uncontrolled shock load caused by an uncoordinated or an arbitrary uncontrolled striking movement of the diver, and which device also comprises means for attaching to the diver's body or the diver's equipment in an unmistakable orientation, wherein the activating means comprise a push-button and the push-button further is provided with passages for water, so that the water pressure of the environment under the push-button can be equalized.

* * * * *